United States Patent [19]

Nakayama

[11] 4,317,390

[45] Mar. 2, 1982

[54] BOTTLE OPENER

[76] Inventor: Michio Nakayama, Tokyo, Japan

[21] Appl. No.: 187,704

[22] Filed: Sep. 16, 1980

[30] Foreign Application Priority Data

Jul. 26, 1980 [JP] Japan ..... 55-102904

[51] Int. Cl.[3] ..... B67B 7/08

[52] U.S. Cl. ..... 81/3.2; 141/19; 81/3.48; 128/218 NV

[58] Field of Search ..... 81/3.2, 3.48; 128/218 R, 218 NV; 141/329, 19; 137/251

[56] References Cited

U.S. PATENT DOCUMENTS 2,729,124 1/1956 Farandatos ..... 81/3.2

FOREIGN PATENT DOCUMENTS 1230326 12/1966 Fed. Rep. of Germany ..... 81/3.2
1350518 12/1963 France ..... 81/3.2
17718 9/1967 Japan ..... 81/3.2
369978 7/1963 Switzerland ..... 81/3.2

*Primary Examiner*—Roscoe V. Parker
*Attorney, Agent, or Firm*—Armstrong, Nikaido, Marmelstein & Kubovcik

[57] ABSTRACT

A bottle opener comprises a bomb; a cylindrical body encasing the bomb; a needle mounted on the cylindrical body; a cylinder wherein are disposed an air flow path for guiding the gas released from the bomb to the needle, a piston having a valve for opening and closing the air flow path, a bomb needle for breaking through a gas outlet port of the bomb, and a variety valve; a lid body mounted on the cylinder; a handle pivotably mounted on the lid body for operating the piston; and airtight sealing members for forming airtight seals between the handle, the cylindrical body, the bomb, the piston and the cylinder. The bottle opener can be used a plurality of times with a single bomb and is capable of withstanding use over a long period of time in safe and without leakage.

6 Claims, 4 Drawing Figures

BOTTLE OPENER

BACKGROUND OF THE INVENTION (1) Field of the Invention

The present invention relates to a bottle opener and, more particularly, to an improvement in a bottle opener which is capable of opening a bottle tightly sealed with a cork or the like in a simple and certain manner.

(2) Description of the Prior Art

A bottle opener is known with which a bottle is opened by inserting a penetrating needle into the cork sealing the bottle and introducing a gas such as carbon dioxide gas into the bottle through the penetrating needle.

As an example of such a known bottle opener, the one that is disclosed in the Japanese Patent Publication No. 42-17718 (1967) is illustrated in FIG. 1. Referring to this figure, numeral 51 denotes a cylinder which has at its bottom end an opening 51*a* through which extends a penetrating needle 53 with a through hole 52. The penetrating needle 53 is supported by its head portion 53*a* in the opening 51*a*. A groove 53*b* is formed at the head portion 53*a*. Numeral 54 denotes a bomb in which is filled an agent for generating gas such as carbon dioxide gas and has at its upper surface a gas outlet port 54*a* which is closed by a metal film. This bomb 54 is encased in the cylinder 51 and spaced from it by a distance which allows the gas to pass between the bomb 54 and the cylinder 51. Numeral 55 denotes a projecting rod fixed to a support 56. This projecting rod 55 is biased upward by a coil spring 57 and is disposed in a through hole 59 formed in a holding body 58. The projecting rod 55 also protrudes from a bottom plate 58*a* of the holding body 58 so as to face the gas outlet port 54*a*, that is, the metal film of the bomb 54. Numeral 60 denotes an outer cylinder fixed to the holding body 58, and together these constitute a cap body which is screwed to the cylinder 51. At the top surface of the support 56 is rotatably mounted a ball 61. Numeral 62 denotes a plunger with a hollow part 63, which has at its bottom surface a metal pressing part 64 for the ball 61. The metal pressing part 64 is disposed in a recess 65 of the outer cylinder 60 and is axially supported on a shaft 66. Numeral 67 denotes a coil spring inside the hollow part 63 which is interposed between the plunger 62 and the outer cylinder 60 so that the metal pressing part 64 does not constantly press the ball 61.

In a conventional bottle opener of the above construction, when the penetrating needle 53 is inserted into a cork sealing a bottle, and the plunger 62 is pressed while the cylinder 51 is held, the plunger 62 pivots about the shaft 66 against the biasing force of the coil spring 67 so as to press the ball 61. The projecting rod 55 is pressed downward by the ball 61 and breaks through the metal film of the gas outlet port 54*a* of the bomb 54. The gas in the bomb 54, such as carbon dioxide gas, flows out and passes through the space between the bomb 54 and the cylinder 51. The gas further flows inside the through hole 52, through the groove 53*b* of the penetrating needle 53, and into the bottle. The gas thus introduced inside the bottle raises the internal pressure and presses the cork upward. The cork is thus removed.

However, with this type of bottle opener, once the gas outlet port of the bomb is broken, the entire gas inside the bomb is exhausted through the through hole of the penetrating needle until the pressure inside the bomb equals the external pressure. Consequently, the bomb must be replaced every time a bottle is opened. This is extremely uneconomical. Further, the bottle itself often breaks before removing the cork, when the strength of the bottle used is smaller than the pressure of the gas to be introduced from the bomb into the bottle. The bottle opener of this type was further found to be defective for long-term use since the space between the bottom plate and the projecting rod and the space between the support and the through hole can become widened so that the gas to be introduced from the bomb into the bottle leaks out.

SUMMARY OF THE INVENTION

It is, therefore, the primary object of the present invention to provide an improved bottle opener which is capable of removing, in a simple and certain manner, a cork or the like tightly sealing a bottle.

It is another object of the present invention to provide a bottle opener of a construction according to which a bomb filled with an agent for generating gas such as carbon dioxide gas to be introduced into the bottle may be used for opening bottles a plurality of times.

It is a further object of the present invention to provide a bottle opener which is capable of opening a bottle safely without breaking the bottle.

It is a still further object of the present invention to provide a bottle opener of a construction which is capable of withstanding use over a long period of time and which does not allow leakage of the gas.

A bottle opener in accordance with the present invention is constructed in the manner to be described below. An agent for generating gas such as carbon dioxide gas is filled in a bomb which has a gas outlet port. A cylindrical body encases the bomb with a predetermined space therebetween. A needle member is mounted at one end of the cylindrical body and communicates with the above-mentioned space. A cylinder is screwed to the other end of the cylindrical body and has a bomb needle which faces the gas outlet port of the bomb. A gas flow path is formed in the cylinder in the bomb needle and the above-mentioned space. A piston has at one end a valve for opening and closing the gas flow path and is constantly biased by a first elastic member in a direction to close the path. A lid is mounted on the cylinder. A handle is mounted on the lid for acting on the other end of the piston so that the piston is constantly biased in the closing direction by a second elastic member. Airtight sealing members are also included in the cylinder between the cylindrical body and the cylinder, between the bomb and the bomb needle, and between the piston and the cylinder. The airtight sealing member interposed between the bomb and the bomb needle preferably has a central hole communicating with the bomb needle and comprises a thick, substantially disk-shaped member having at its periphery an opening connecting the safety valve and the above-mentioned space and another opening through which extends the air flow path.

BRIEF DESCRIPTION OF THE DRAWINGS

Other features and objects of the present invention will be apparent to the skilled in the art when reference is made to the following detailed description and the accompanying drawings, wherein.

DETAILED DESCRIPTION OF THE PREFERRED EMBODIMENT

Figure 1:
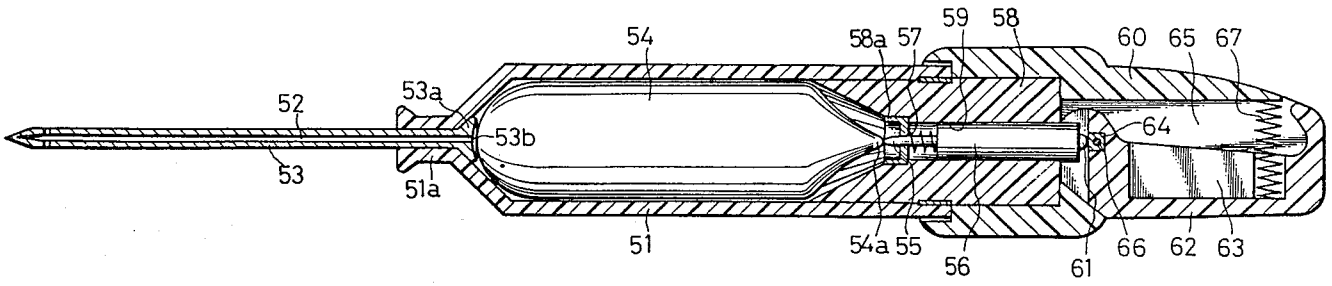
FIG. 1 is a vertical sectional view illustrating a conventional bottle opener.
Figure 4:
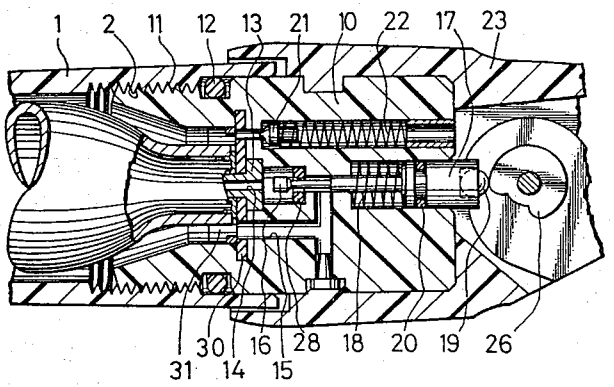
FIG. 4 is a partially cutaway, vertical sectional view illustrating the main part of the embodiment shown in FIG. 2.
Figure 2:
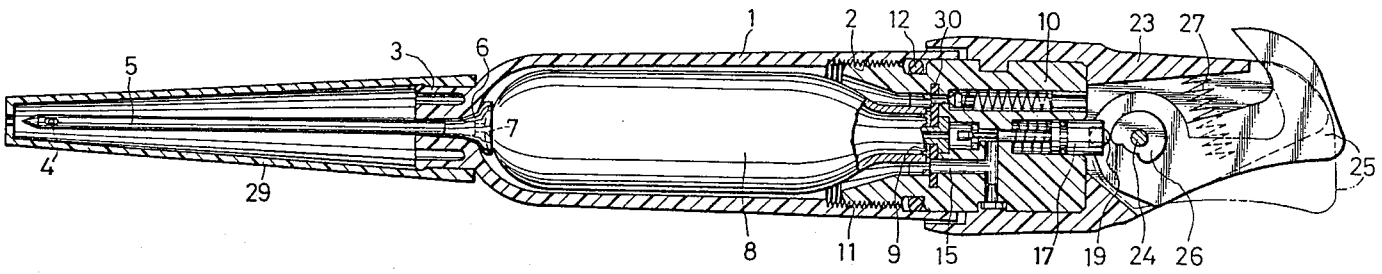
FIG. 2 is a partially cutaway, vertical sectional view of a bottle opener in accordance with one embodiment of the present invention.
Figure 3:
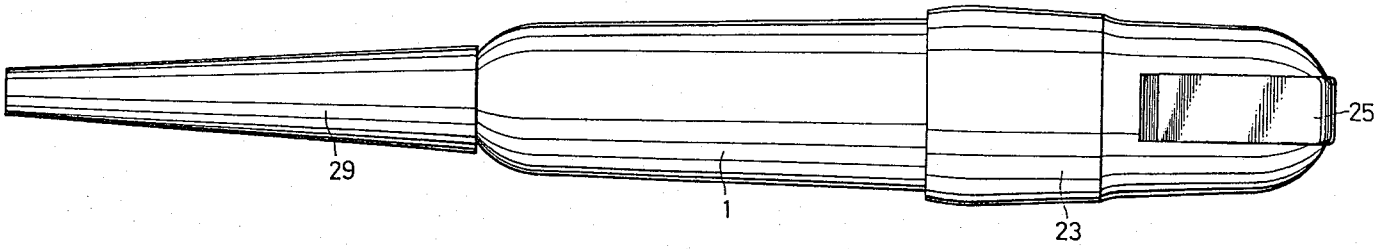
FIG. 3 is a front view of the embodiment in FIG. 2.

FIG. 2 is a partially cutaway, vertical sectional view of a bottle opener in accordance with one embodiment of the present invention, FIG. 3 is a front view of FIG. 2, and FIG. 4 is a partially cutaway, vertical sectional view illustrating the main part of the bottle opener shown in FIG. 2. Throughout these figures, the same reference numerals denote the same parts.

Referring to the drawings, numeral 1 denotes a cylindrical body. The cylindrical body 1 is of substantially cylindrical shape and has screw threads 2 at the upper end of its inner surface (the end to the right in FIG. 2). The cylindrical body 1 is tapered toward its other end, the lower end, and has an opening 3 at this end. Through the opening 3 penetrates a needle 5 which has a through hole 4 inside, and a head portion 6 of the needle 5 is provided with a groove 7 and is mounted in the opening 3 of the lower end of the cylindrical body 1. Numeral 8 denotes a bomb which is filled with an agent for generating gas such as carbon dioxide gas and which has at its upper end a gas outlet port 9 which is closed with a metal film. The cylindrical body 1 encases the bomb 8 with a predetermined space therebetween. The space and the through hole 4 of the needle 5 are connected through the groove 7 of the head portion 6.

The bomb 8 is encased inside the cylindrical body 1 with its gas outlet port 9 oriented away from the needle 5 and facing a cylinder 10. At the lower edge of the outer surface of the cylinder 10 are formed screw threads 11 for threadable engagement with the screw threads 2 formed at the upper end of the inner surface of the cylindrical body 1. An airtight sealing member, for example, an O-ring 12 is disposed at the position where the cylinder 10 and the cylindrical body 1 overlap each other for forming an airtight seal between the cylinder 10 and the cylindrical body 1.

A bomb needle 13 is disposed on the cylinder 10 so that it faces the gas outlet port 9 of the bomb 8. The bomb needle 13 is used for the purpose of breaking through the metal film attached to the gas outlet port 9 and is of substantially conical shape with a communicating hole 14 at its center. A gas flow path 15 is formed in the cylinder 10 joining the communicating hole 14 of the bomb needle 13 with the space between the cylindrical body 1 and the bomb 8. In this gas flow path 15 is disposed a piston 17 which has a valve 16 at one end for opening and closing the gas flow path 15 and which is constantly biased by a first elastic member, a coil spring 18, toward the closing direction. The other end of the piston 17 protrudes upwardly into the cylinder 10, and a ball 19 is rotatably supported on the top surface of the piston 17. An airtight sealing member, for example, an O-ring 20 is mounted on the outer circumference of the piston 17 for forming an airtight seal between the piston 17 and the cylinder 10. A safety valve 21 communicating with the above-mentioned space is mounted in the cylinder through a coil spring 22 so that when the pressure inside the space exceeds a certain value, the air inside is exhausted.

A lid body 23 is mounted on the cylinder 10, and a handle 25 is pivotably mounted inside the lid body 23 on a pivot shaft 24 supported by the lid body 23. A cam 26 is fixed to the pivot shaft 24. As the cam 26 pivots, the ball 19 mounted on the top surface of the piston 17 is pressed downward and opens the valve 16. A second elastic member, for example, a coil spring 27 is interposed between the handle 25 and the lid body 23 for constantly biasing the valve 16 in the closing direction.

The valve 16 as described above is a valve for opening and closing the gas flow path 15 and comprises a big diameter portion at one end of the piston 17. An O-ring 28 is interposed between the valve 16 and the gas flow path 15 for complete sealing. A cap 29 can be mounted to cover the needle 5 for safety at the opening 3 of the cylindrical body 1.

The gas outlet port 9 of the bomb 8 and the bomb needls 13 are constructed in the manner in accordance with the present invention to be described hereinbelow for preventing gas leakage. An airtight sealing member, for example, a thick disk-shaped rubber ring 30 is interposed between the conical bomb needle 13 and the gas outlet port 9. The rubber ring 30 has at its central part a central hole through which extends the bomb needle 13; at its periphery it has an opening for connecting the safety valve 21 with the abovementioned space and an opening through which passes the gas flow path 15. A guide ring 31 for correctly guiding the bomb needle 13 to the gas outlet port 9 of the bomb 8 is disposed at the center of the bottom of the cylinder 10.

The operation of the bottle opener of the above-mentioned construction will now be described.

The bomb 8 filled in advance with a gas is correctly mounted in the cylindrical body 1 in such a manner that its gas outlet port 9 faces upward in the cylindrical body 1. Thereafter, the lid body 23 is slowly turned and screwed to the lower end of the cylindrical body 1. When the lid body 23 is screwed to the cylindrical body 1, the gas outlet port 9 of the bomb 8 correctly faces the bomb needle 13 through the guide ring 31 mounted on the cylinder 10. The bomb needle 13 breaks through the metal film of the gas outlet port 9. Since the handle 25 is not being gripped by a hand, the valve 16 closes the gas flow path 15 by the biasing force of the coil springs 18 and 27. Thus, the gas flowing out of the bomb 8 flows from the communicating hole 14 of the bomb needle 13 to the valve 16, but does not flow along the gas flow path 15. Since the thick disk-shaped rubber ring 30 of large diameter is interposed between the gas outlet port 9 and the bomb needle 13, the gas from the bomb 8 does not leak into the space between the bomb 8 and the cylindrical body 1. Since the rubber ring 30 is thick, it strongly resists degradation and secular changes caused by the gas outflowing from the bomb 8 and is capable of withstanding use over long periods of time.

For opening a bottle sealed by a cork or the like using this bottle opener, after the cap 29 is removed, the needle 5 is inserted in the cork and the handle 25 is firmly gripped. The cam 26 of the handle 25 pivots against the biasing force of the coil springs 18 and 27 and presses the piston 17 downward. When the piston 17 is pressed downward, the valve 16 opens the gas flow path 15 (as shown in FIG. 2). The gas inside the bomb 8 thus passes along the gas flow path 15, into the space between the cylindrical body 1 and the bomb 8, into the through hole 4 of the needle 5 and into the bottle. When the pressure inside the bottle gradually increases and to the point at which the cork is not able to withstand the pressure, the cork pops out of the bottle. After opening the bottle, the handle 25 is released, thereby automatically closing the valve 16 by the biasing force of the coil springs 18 and 27 so as to prevent the gas in the bomb 8 from leaking out. Accordingly, the bottle opener may be used for opening bottles a plurality of times as long as the gas generating agent filled in the bomb 8 generates gas of the required pressure.

With the conventional bottle opener, accidents often occured in which the cork could not be removed easily and the bottle was broken. However, with the bottle opener of the present invention, such accidents can be prevented in advance by adjusting the elasticity of the coil spring 22 of the safety valve so that the gas is released to the outside when the pressure inside the bottle exceeds a certain value.

It is to be understood that many modifications can be made without departing from the spirit and scope of the present invention. Therefore, the present invention is not to be construed as restricted to the specific embodiment described except as defined in the appended claims.

What is claimed is:

1. A bottle opener comprising a bomb filled with an agent for generating gas such as carbon dioxide gas and having a gas outlet port; a cylindrical body encasing said bomb with a predetermined space therebetween; a needle member mounted at one end of said cylindrical body and communicating with said space; a cylinder screwed to the other end of said cylindrical body in which are disposed, a bomb needle facing said gas outlet port of said bomb, a gas flow path communicating with said bomb needle and said space, a piston having at one end a valve for opening and closing said gas flow path which is constantly biased by a first elastic member in a direction for closing said path, and a safety valve communicating with said space; a lid body mounted on said cylinder; a handle for acting on the other end of said piston which is mounted on said cylinder and which is constantly biased by a second elastic member in a closing direction; and airtight sealing members disposed between said bomb and said cylinder, between said bomb and said bomb needle, and between said piston and said cylinder.

2. A bottle opener as claimed in claim 1 characterized in that the airtight sealing member interposed between said bomb and said bomb needle is thick and substantially disk-shaped and has a central hole penetrated by said bomb needle and, at its periphery, an opening which connects said safety valve and said space and an opening through which extends said gas flow path.

3. A bottle opener as claimed in claim 1 or 2 characterized in that said valve comprises a projecting part of large diameter formed at the end of said piston and an airtight sealing member interposed between said projecting part and said gas flow path.

4. A bottle opener as claimed in claim 1 or 2 characterized in that said safety valve comprises a needle valve and a coil spring.

5. A bottle opener as claimed in claim 1 or 2 characterized in that engagement of said handle with said piston is effected by a cam mounted on said handle and a ball rotatably supported on said piston.

6. A bottle opener as claimed in claim 1 or 2 characterized in that said first elastic member and said second elastic member are coil springs.

* * * * *

UNITED STATES PATENT AND TRADEMARK OFFICE

CERTIFICATE OF CORRECTION

PATENT NO. : 4,317,390

DATED : March 2, 1982

INVENTOR(S) : MICHIO NAKAYAMA

It is certified that error appears in the above-identified patent and that said Letters Patent are hereby corrected as shown below:

In Col. 6, claim 1, line 10, please delete "between said bomb and said cylinder," and insert therefor --between said cylindrical body and said cylinder,--.

Signed and Sealed this

*Seventh* Day of *September 1982*

[SEAL]

*Attest:*

GERALD J. MOSSINGHOFF

*Attesting Officer*

*Commissioner of Patents and Trademarks*